United States Patent [19]

Anderson

[11] Patent Number: 4,889,459

[45] Date of Patent: Dec. 26, 1989

[54] FURTHER IMPROVED OVERHEAD SHEET-INSTALLATION SUPPORT TOOL

[76] Inventor: Paul C. Anderson, 143 Maple Ave., Chester, N.J. 07930

[21] Appl. No.: 230,039

[22] Filed: Aug. 9, 1988

Related U.S. Application Data

[63] Continuation-in-part of Ser. No. 209,924, Jun. 22, 1988, abandoned.

[51] Int. Cl.[4] ..... F16B 23/00; F16B 35/06

[52] U.S. Cl. ..... 411/400; 411/409; 248/217.4; 52/DIG. 1

[58] Field of Search ..... 411/400, 401, 409, 919; 248/217.4; 81/DIG. 1, 180.1; 52/DIG. 1

[56] References Cited

U.S. PATENT DOCUMENTS

| | | | |
|---|---|---|---|
| 648,531 | 5/1900 | Rossman | 411/409 |
| 977,835 | 12/1910 | Piscator | 248/217.4 |
| 1,103,723 | 7/1914 | Witte | 411/409 |
| 1,188,305 | 6/1916 | Noerteman | 411/409 |
| 1,211,347 | 1/1917 | Plofchan et al. | 248/217.4 |
| 1,289,450 | 12/1918 | Holaday | 411/409 |
| 2,830,478 | 4/1958 | Prince | 81/180.1 |

FOREIGN PATENT DOCUMENTS

| | | | |
|---|---|---|---|
| 15496 | of 1913 | United Kingdom | 248/217.4 |

*Primary Examiner*—Neill R. Wilson

*Attorney, Agent, or Firm*—William T. Hough

[57] ABSTRACT

There is provided an overhead sheet-installation support tool inclusive of a forwardly-directed tapered threaded screw with a tapered threaded forward distal end and having rearward-extending handle structure with opposite flattened sides spaced-apart by a minor handle-thickness, and having forward shoulders angled rearwardly at laterally outwardly distal ends thereof and with the forward shoulders' edges extending in opposite lateral directions at about 90 degrees to oppositely-extending flattened lateral flattened handle surfaces. There are flat-faced support members mounted intermittently adjustably on one of the flattened handle surfaces with support member distal ends each separately movable, each of the arcuate members when in an upwardly-extended state being in juxtaposition to one of spaced-apart rearwardly-extending edges of the handle structure and spaced-away from the threaded screw.

19 Claims, 2 Drawing Sheets

FURTHER IMPROVED OVERHEAD SHEET-INSTALLATION SUPPORT TOOL

SPECIFICATION

Figure 1:
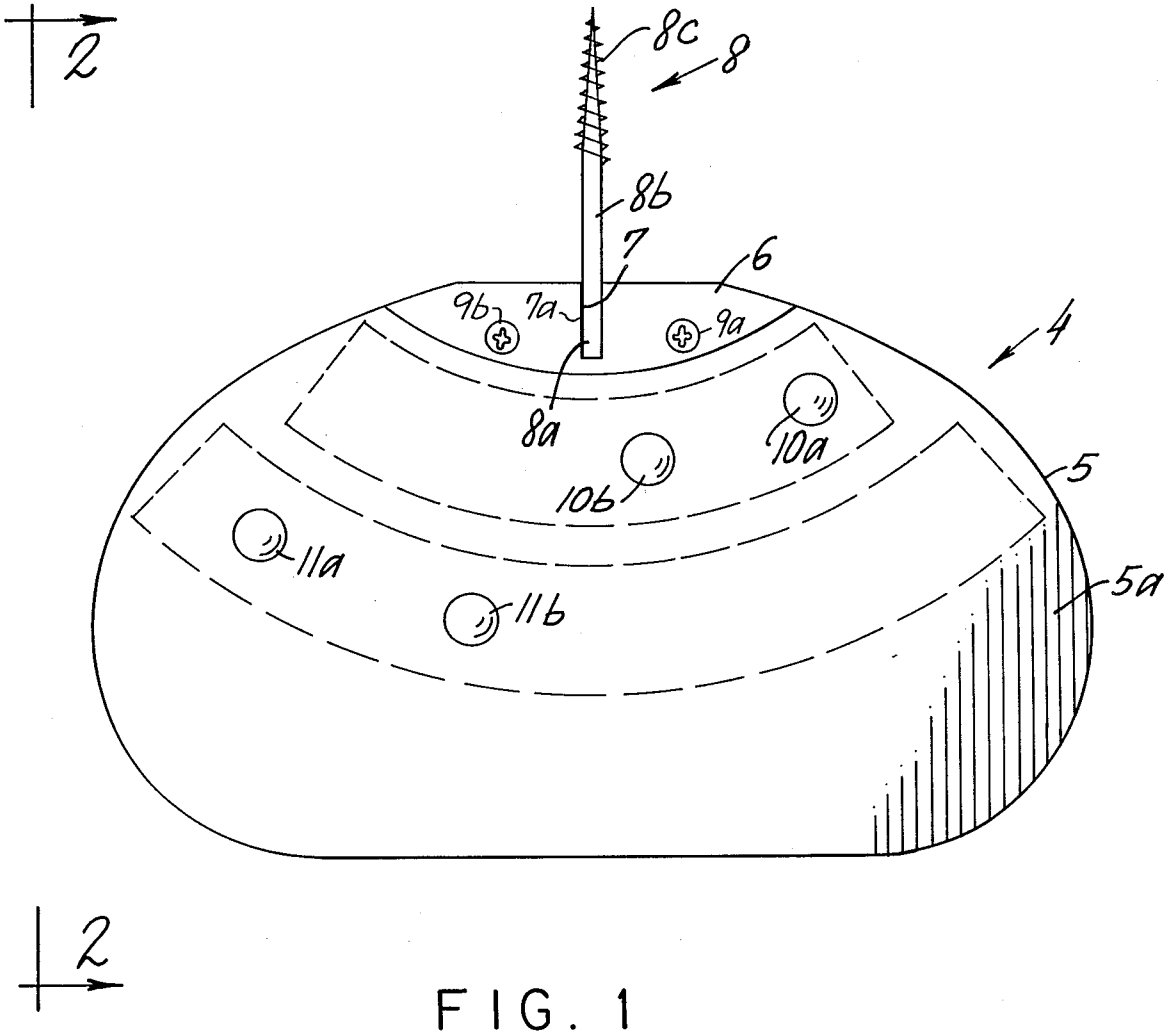

This invention is directed to an improved overhead sheet-installation support tool to assist a workman in the installation of overhead drywall (sheetrock), plywood or the like and is a continuation-in-part of and incorporated by reference the entire disclosure of the same inventor's copending patent application U.S. Ser. No. 07/209924 filed June 22, 1988, now abandoned.

PRIOR ART

While no relevant prior art was located by the inventor, prior non-analagous patents having no bearing on the invention, and distinguished in the language of the claimed invention, include the following. U.S. Pat. No. 933,831 to DeSteiger re a machine screw having an insertable handle-accessory; U.S. Pat. No. 889,925 to Hampton and Eagle regarding a shade roller bracket by virtue of a shade-rode key-receiving slot configuration in one of a pair of shade-mounts, and a shade-rod shaft-receiving hole in the second member of the pair, each of the shade-mount including a forward-end screw for the permanent-mounting of the pair; and U.S. Pat. No. 4,158,455 to Brown for a jig member for holding a planar sheet material during installation.

BACKGROUND

Installation of the ceiling materials has previously been a difficult task generally involving two or more people and wooden supports called "T-bars", or cumbersome and expensive hydraulic or mechanical lifts. T-bars and lifts are even more difficult to use when applying sheetrock to the underside of rafters. Typically previously for the installation of sheetrock (for typically installing as a ceiling), commonly referred to as "drywall", two or more persons are required, at-least one person to hold-up (support) one end while the opposite end is being tacked to the overhead beam. Use of T-bars or the like does not diminish the need and requirement of two or more workmen to do the job. Accordingly, the cost in installation, requiring special expensive devices and/or more than one person, typically two or more persons working together to assure non-slipping and accuracy of and during installation, is esculated to time charges eventually borne by the contractor or home-buyer or the like, i.e. by the consuming public. The support tool of the inventor's above-noted copending U.S. Ser. No. 07/209924 while achieving great success in actual use on the job has been found to be subject to excessive torque forces causing the screw shaft to bend and/or break during and/or after repeated use thereof, because of the large weight supported by the laterally-extending forwardly-positioned shoulder(s) of the support tool, particularly when there is the frequently-occuring situation of a sheet being supported on one of the shoulders but not on the other remaining shoulder of the support tool.

OBJECTS OF THE INVENTION

Accordingly, a primary object of the invention is to overcome problems and difficulties of the types discussed-above, particularly the above-noted torque-problem that served to cause bending and/or breakage of the shank or shaft of the screw when anchored in an overhead beam and supporting a sheet on one shoulder thereof.

Another object is to provide a mechanism in combination with the support member, for temporarily locking a sheet into a position against a beam's lower or side face (as the case may be) to allow opportunity for a person working-along, to secure the sheet with less difficulty.

Another object is to obtain an overhead sheet-installation support tool achieving the foregoing object and making possible high quality installation devoid of complicated or expensive devices and devoid of helpers beyond a single, individual installing worker.

Another object is to achieve the foregoing objects together with facilitating "lining" a deteriorating plaster ceiling with sheetrock.

Another object is to obtain an accessory installation tool easily adjustable to vary required or desired distance for suspension from an overhead support, as required or desired for sheets of different thicknesses and for installations requiring different working-room, and the like.

Another object is to facilitate ease in the supporting of a sheet in very close proximity to a ceiling or beam to which the sheet is to be secured, during measuring and thereafter intermittent cutting and refitting or remeasuring and/or attaching the sheet, during the installation process.

Another object is to obtain a device which may be used with assured safety, devoid of any substantial degree of hazard of not "holding" while supporting heavy sheetrock or other comparable sheet material.

Another object is to provide a sheetrock-mounting accessory tool of a configuration facilitating easy handling, availability and use during the installation.

Another object is to provide a tool of the foregoing type indicated, with support structure adapted to avoid defacing supported sheet(s).

Another object is to provide a tool of the foregoing type indicated, with a mechanism providing for a detachably mounted screw while retaining strength and durability of the tool as a whole.

Another object is to provide an improved mechanism for mounting a screw on a tool of the foregoing type indicated.

Other objects become apparent from the preceding and following disclosure.

SUMMARY OF THE INVENTION

The invention may be broadly described as an overhead sheet-installation support tool having as a primary improvement, a plurality of separate adjustable at-least first and second support members having respectively upper first and second distal ends, the first support member being mounted in a position such that in an upwardly extended state the first support member is in juxtaposition to one of spaced-apart rearwardly-extending edges of the handle structure and spaced-away from the screw, and the second support member being mounted in a different location such that in an upwardly-extended state the second support member is in juxtaposition to the screw and spaced-away from the spaced-apart rearwardly-extending edges of the handle structure. The improved combination-tool also has a tapered screw tapering from a proximal end to a distal end. As above-noted, the improved tool has laterally-extending forwardly-positioned shoulder(s) and handle structure(s). The improved tool has rearwardly-extending handle structure that may or may not be combined with the shoulder-structure above-described; in any event, the combined dimensions of the laterally-extending shoulder(s) and handle structure(s) extend rearwardly at-least sufficiently graspable and to forcefully manually finger-twist the tool screwably into beams, rafters or the like. The handle structure has at-least one face thereof critically substantially flattened (noting that minor curvature would be acceptable), and of the above-noted width and rearward extension dimensions. The handle's rearwardly-extending flattened lateral surface(s) critically extend(s) in a plane substantially parallel with and substantially aligned with the longitudinal axis of the screw—essential, such that the handle structure with its/their flattened face(s) (surface(s)) necessarily do(es) not interfere with, i.e. provides free-space in juxtaposition thereto for moving past the flattened lateral surface an end of a rigid sheet-structure. The laterally extending flange structure(s)'s forwardly positioned side-surface(s) likewise critically extend in a plane substantially parallel to and aligned with the flattened lateral surface such that, again, the one or more flange(s)'s side surface(s) is/are positioned to provide free-space in juxtaposition thereto for moving past said one forwardly-directed flange side surface an end of a rigid sheet structure toward a forward (upward) mounting position for a rigid sheet structure. The first and second adjustable flat-faced support members each separately are mounted with a flat-face thereof mounted flushly (parallel to and in face-to-face flat relationship) against one of the flat faces of the flat faces of the handle structure, and each mounted on opposite sides of the screw from the other one. Each of the first and second support members is adjustably securable for intermittent locking and loosening and for adjusting an end thereof intermittently toward, to and alternately away from a level of support-beam or ceiling. The first support member optimally serves as a brace against torque caused or to be caused by support of a sheet on a shoulder or on a second distal end located on an opposite side of the screw's shank or shaft. Each of the critically-positioned adjustable first and second support members critically prevent the bending or breaking of the shaft or shank of the screw by countering the torque caused by a sheet being supported or pinned-by an oppositely-extending shoulder and/or flange or by an oppositely located support member adjustably mounted on the handle structure.

Accordingly, the second support member is critically positioned in a location close to the shank in order to reduce torques on the shank or shaft when in its raised state of its upper distal end, while the other (first) support member in its raised state (for its upper distal end) is spaced away from the screw, in juxtaposition to one of the above-noted spaced-apart sides, on an opposite side of the screw shank or shaft. The second support member, being closest to the screw, optimally may be used to hold a sheet in a state against a lower surface of a supported sheet while nailing the sheet into a second position against a beam's or ceiling's lower or side (as the case may be) surface for an intermittent period during which a worker working-alone may be better able, with two free hands, to nail or otherwise secure the sheet to the beam or ceiling or the like.

In another preferred embodiment the adjustable support members are arcuate support members; preferably each has an elongated arcuate slot extending along its length-dimension or length-axis, through which spaced-apart bolts are inserted and anchored typically and preferable by wing nuts, adjustably intermittently lockable through spaced-apart bolt-holes in a flat face of the handle structure typically and preferable by manually tightenable wing nuts respectively.

The tool preferably includes a sidewardly extending flange extending from an upper edge of the shoulders at about 90 degrees angle relative to flattened opposite faces of the handle structure, critically providing, for this preferred embodiment, essential (critical) sheet-support by which weight of a sheet is distributed thereon avoiding an upright-edge from cutting or defacing the decorative lower face of the sheet, while or when maneuvering the sheet-end, the flattened face of the flange being thereby less likely to mar or damage a lower face of the supported sheet. Likewise the preferred rearwardly directed opposite ends of the above-described flange serve to prevent gouging sheets during the handling thereof about the flange.

The screw preferably contains at least a major amount of hardened steel—desirable for enduring stress and strain of repeated screwing into beams, removing, and bearing-up durably and safely while supporting heavy loads.

Preferably each or both of opposite shoulders has a forward leading edge angled rearwardly from a laterally-extending perpendicular "zero" degrees up to a critical maximum number of degrees of about ten degrees, angling rearwardly as the shoulder(s) extend(s) rearwardly. This facilitates and/or makes possible the position of the shoulders beneath an elevated end of a raised end of a rigid sheet-structure by revolving the handle structure about 90 degrees while concurrently the shoulder(s) provide(s) stable support for mounting thereupon a raised end of a rigid sheet-structure.

In another preferred embodiment, the screw threads angle ranges from about 44 to 46 degrees for a practical combination of adequate holding, speedy insertion, and easy insertion of the screw by revolving while applying moderate forward pressure thereto against the rafter or beam or the like.

The preferred screw length—inclusive of the tapered portion and of the shank or shaft, sufficient to to provide adequate working room and sufficient screw-holding depth, and to allow for sheets of varying different thicknesses, ranges from a practical minimum of about one and one-half inches to about three inches.

Likewise, preferably for the best combined holding capability, with easy insertion, the screw has from about seven top nine threads per inch.

Preferably for making possible the mounting of adjacent sheet-ends supported in juxtaposition, the handle structure and flange structure (which may or may not be combined into a single integral structure), each and both have opposite (i.e. two) flattened surfaces or faces. Also, having each of opposite sides flattened, makes is possible to optionally turn either flat face toward a space through which a sheet end will be lifted past the tool to a location above the shoulder's forward side surface (on which the sheet end will be supported).

For normal conventional operations, while providing a desired and preferred margin of safety against potential hazard of accidental slipping of a sheet from the supported position on a forwardly-directed flange side surface, the rearward angle above-discussed preferably ranges from about two degrees to a critical maximum of about five degrees.

The shoulder extends laterally in each of opposite directions, to provide two, alternate or selectable forwardly-directed side surfaces of the two oppositely-extending shoulder structures, again providing for the supporting concurrently of adjacent ends of two spaced-apart sheetrock sheets, for example. However, in a preferred embodiment, combining both the advantage of greater strength and durability of the tool with also ease of manufacture, the shoulder structure and forward side (supporting) flat face of the flange (previously discussed) are preferably combined into a single integral structure with the handle structure above-discussed. In such embodiment, the thickness between opposing or opposite flat surfaces of the flange and/or handle structure and/or shoulder(s) thereof, is preferably from about one-thirty-second inch to about one inch.

The practical and thereby preferred combined width of the integral structure for easy and forceful handling and to avoid the flanges from getting in the way during and between uses thereof, critically ranges from a minimum of about three inches to about 9 inches maximum.

For the same reasons above-stated, particularly providing essential durability and supporting strength, the thickness of the integral structure ranges more preferably from critically about one-sixteenth into to about three-quater(fourths) inch, for required lightness and for most useful non-interfering massive bulk but with sufficient retained strength and durability.

The most preferred composition of the screw is hardened steel of hardened #2 grade steel, providing a maximum critical durability and strength.

The invention may be better understood by making reference to the following figures.

THE FIGURES

FIG. 1 diagrammatically and symbolically illustrates a face-on side view of the most preferred embodiment of the present invention.

Figure 2:
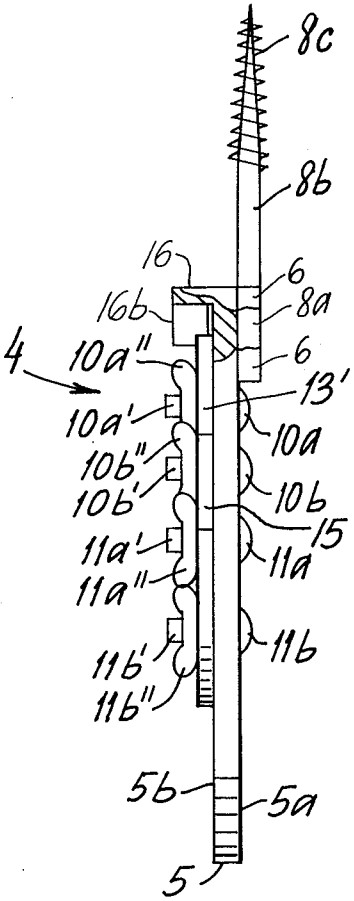

FIG. 2 diagrammatically and symbolically illustrates an edge-view of the embodiment of FIG. 1, with partial cut-away showing the flange structure and wing nuts mounted on male-threaded bolt-shanks extending through bolt-hole apertures in the flat-faced handle structure.

Figure 3:
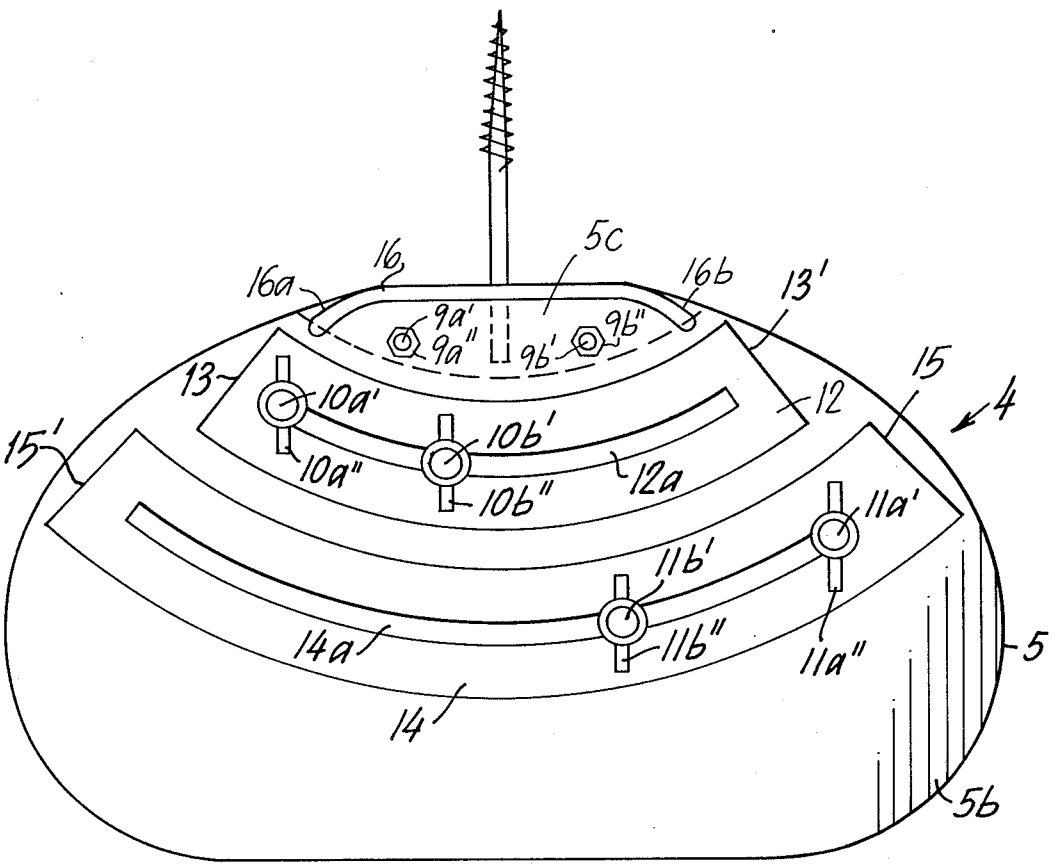

FIG. 3 diagrammatically and symbolically illustrates an opposite side-face view of the embodiment of FIG. 1.

DETAIL DESCRIPTION

FIGS. 1 through 3 disclose a common embodiment embodying all preferred features, and accordingly use common indicia for corresponding parts, where illustrated in more than one figure.

With particular reference to all figures, there is disclosed a more optimum preferred embodiment. There is shown the sheet-mounting support tool 4, inclusive of the integral structure that combines the handle structure, its shoulders, and the flange structure 16 having downwardly-curved opposite ends 16*a* and 16*b*. Integrally and rigidly connected to and extending forwardly from the handle structure, is the screw 8 inclusive of its distal tapered thread end 8*c*. The above-noted sidewardly-directed flange 16 extends in a direction defining an angle of about 90 degrees relative to the flat face shown in side view of FIG. 2. Diagrammatically, the screw 8 is shown with the screw's distal end 8*c* threads thereof, that would be screwed-into and thereby mounted within typically a lower face of a wooden beam or rafter shown in phantom. FIG. 1 further illustrates preferred arcuate members (in phantom in FIG. 1) adjustably mounted and locked-onto shafts of bolts 10*a*, 10*b*, 11*a*, and 11*b* that extend through the plate apertures of the handle structure face 5*a*. Detachable plate 6 has a slot 7 and is mounted by screws or bolts 9*a* and 9*b* onto the handle structure portion 5 (onto the flat face thereof). Screw shaft 8*b* has its proximal end mounted within slot 7 by typically electric welding or solder 7*a*. Accordingly, the preferably flat ends 13' and 15' of the arcuate members 12 and 14 are shown in FIG. 3 in typically retracted positions and states. In an extended state, they brace supportingly against the lower surface of a beam and/or pin a sheet in a raised state. The weight and/or pressure of a supported or pinned sheet is counter-balanced by the oppositly-positioned (on an opposite side of the screw shank) other extended support member extended into contact typically with an overhead lower surface of a ceiling or beam. Accordingly, a lower surface of a sheet may be braced by the upper preferably flat end 13' of the arcuate member 12, while flat end 15' is braced against a lower face of a beam or ceiling, for example. The arcuate member 12 rides on a shaft of the bolts 10*a* and 10*b* that are in slot 12*a*, secured by wing nuts 10*a*'' and 10*b*''. In the same manner, the arcuate member 14 rides on the shafts 11*a*' and 11*b*' of bolts 11*a* and 11*b* in slot 14*a*.

FIG. 2 further illustrates an in-part view taken along line 2—2 of FIG. 1, illustrating the relationship of the arcuate members and of the flange 16 shown in partial cut-away, for improved understanding.

FIG. 3 illustrates substantially the same member and elements as that of FIGS. 1 and 2, but showing the opposite face in greater detail in cut-away portions. Additionally, there is shown the male threaded bolt-ends 9*a*' and 9*a*'' typically such as 11*b* and 17*b* having mounted wing nuts 9*b*' and 9*b*''. It is noted that also this FIG. 3, in order to better illustratively show the position of the lowered opposite flange-ends 16*a* and 16*b*, shows in partial cut-away the owered (rearwardly-extending) ends effectively reducing the possibility of damage to the sheetrock decorative lower face of its end portion when lifted to and supported on flange 16.

Accordingly, by the present invention, an overhead sheet-installation support tool is disclosed and described, having opposite flat faces on the handle portion, rigidly integral with the plate-mounted forwardly-directed screw, characterized as above-described, for temporarily supporting and/or pinning into nailing-position one end of a rigid or substantially rigid sheet such as sheetrock or plywood or the like and/or concurrently on the oppositely-extending shoulder having the end 13 of the flat end 15' arcuate member that would be braced against the lower surface in order to thereby provide support against torque and bending or breaking pressures on the screw 8. During the supporting of one or more sheets, as above-noted, the tool is temporarily screwed into the overhead rafter or beam or ceiling or the like. Also, as above discussed, arcuate member 14 braces wile arcuate member 12 has its flat-end 13' pin a sheet into a mounting position and state, awaiting the nailing thereof.

Normal mounting for installing a drywall ceiling typically of four-foot-wide sheets, is typically as described in the parent application, repeated in-part hereinbelow, together with further description of use of the present inventive improvements, for convenience and understanding by the public, as follows, merely symbolic and to improve a working understanding.

Snap calk line across joists (rafters, furring strips, or the like) approximately 48 and three-eights inch from the wall. When using on rafters, start from a bottom wall. Make sure the line is at least 48 and on-eighth inch from the wall at all points. If not, restrike the line. Holding the handle, screw straight into the joist in the center of the chalk line by both pushing upwardly and concurrently turning (revolving) the tool. The screw starts easily and should penetrate at least five-eights inch, but not so (too) much that the drywall will not fit between the joist and the tool's forwardly-directed sheet-supportable side-face above-described. Use two tools positioned (located) beside the sheets (i.e. in this instance, not necessarily at the exact end of the sheet) located approximately one and ½ feet to 2 feet from either (each) end of the each 8 foot sheet. Use three or four tools for longer sheets. Leave the tools, as mounted, in "standby" positions—i.e. turned such that the flange and handle structure do not interfere with the lifting of the sheet(s) past and to a location-above the flange(s), extending (as mounted) perpendicularly downwardly from the joist(s), parallel with long (tapered) edges of the drywall (sheetrock) sheet. After raising a sheet from a position supported on the tools shoulder(s) and from the flange 16, the wing nuts 11*a*″ and 11*b*″ are loosened for the arcuate member 14 and the flat distal end 15 is raised to a bracing-position in contact with a loser surface of the beam (or ceiling, as the case may be). After raising a sheet from a position supported on the tools's opposite shoulder, and flange 7, to a nailing position and state, the wing nuts 10*a*″ and 10*b*″ are loosened and flat end 13 of arcuate member 12 is raised to a position of pinning against a lower surface of the raised sheet-end, culminated by a tightening of the wing nuts 10*a*″ and 10*b*″. After nailing or otherwise securing the sheet-end into a secured state, the wing nuts 10*a*″ and 10*b*″ are loosened, the member's 12 distal end 13 retracted, and thereafter the wing nuts 11*a*″ and 11*b*″ loosened and the distal end 15 retracted, followed by a reverse twisting of the handle structure to remove the tool.

Other procedure described in the parent application may likewise be followed where appropriate.

In the event that the taped threaded end of the screw becomes dulled or bent, or should become broken, the plate 5*c* may be removed and replaced by a reserve other plate carrying a good and sharp replacement screw, thereby avoiding having to discard the entire tool.

It is within the scope of this invention to make such variation and modifications and substitution of equivalents as would be apparent to a person of ordinary skill in this art.

I claim:

1. An overhead sheet-installation support tool comprising in combination: a forwardly-directed tapered threaded screw having a longitudinal axis along its length-dimension and having a forwardly-located screw distal end and a rearwardly-engaged proximal end, the screw being tapered toward and at its forwardly-located screw distal end and said distal end having male screw threads; a handle structure extending rearwardly from said rearwardly-enlarged proximal end, said handle structure having at least one rearwardly-extending flattened lateral surface with the flattened lateral surface extending in a plane parallel with and substantially aligned with the longitudinal axis of the screw such that the handle structure provides free-space in juxtaposition thereto for moving past the flattened lateral surface an end of a rigid sheet-structure toward a forward mounting position for a rigid sheet-structure; and shoulder-forming structure forming at least one forwardly-positioned shoulder structure rigidly continuous with at least one of said screw and said handle structure, the one shoulder structure extending laterally to said longitudinal axis of the screw and said one forwardly-positioned shoulder structure laterally extending along a second longitudinal axis thereof substantially parallel to and aligned with said flattened lateral surface such that the one flattened lateral surface is positioned to provide free-space in juxtaposition thereto for moving past said one forwardly-positions shoulder structure toward a forward mounting position for a rigid sheet-structure; the one forwardly-positioned shoulder structure and the handle structure jointly extending rearwardly sufficiently to be graspable and to allow forceful manual finger-twisting thereof to screw said screw into a beam or rafter; and a plurality of separate manually adjustable at-least first and second support members each of said plurality having at least one member-flat face mounted with the member-flat face parallel to and secured against said flattened lateral surface, said first support member having a first distal end and said second support member having a second distal end, and said first and second support members each being intermittently adjustable and intermittently immovably secureable in different positions and positioned in a mounted state such that said first and second distal ends respectively thereof are movable forwardly of said one forwardly-positioned shoulder structure toward and to be braceable against structure above said one forwardly-positioned shoulder structure when adjusted forwardly, in which said handle structure has spaced apart rearwardly-extending edges, and in which said manually adjustable first support member is mounted at a first position positioned away from said screw in juxtaposition to one of said spaced-apart rearwardly-extending edges such that in an extended state said first distal end thereof is spaced-away from said screw, the second support member being mounted at a second position such that in an extended state said second distal end thereof is in juxtaposition to said screw and spaced away from the spaced-apart rearwardly-extending edges, and the first and second support members being mounted such that in an upwardly extended state the first and second distal ends being located on opposite-sides of the screw from one another.

2. The overhead sheet installation support tool of claim 1, in which said manually adjustable first support member has a first member-length dimension and is arcuate along said first member-length dimension thereof.

3. The overhead sheet-installation support tool of claim 2, in which said second support member includes a second member-length dimension and in which said second support member is arcuate along said second member-length dimension.

4. The overhead sheet-installation support tool of claim 3, in which said first distal end is substantially flat in a direction extending substantially transversely to said first member-length dimension.

5. The overhead sheet-installation support tool of claim 4, in which said second member has a length-dimension and in which said second distal end is substantially flat in a position extending in a direction transversely to said second member's said length dimension.

6. The overhead sheet-installation support tool of claim 1, in which said first member has a length dimension and in which said first distal end is substantially flat in a position extending in a direction transversely to said first member's said length dimension.

7. The overhead sheet-installation support tool of claim 2, in which said second member has a length-dimension and in which said second distal end is substantially flat in a position extending in a direction transversely to said second member's said length-dimension.

8. The overhead sheet-installation support tool of claim 5, including an intermittently-detachable flat-faced plate mounted on said one rearwardly-extending flattened lateral surface, and said screw being immovably mounted onto said flat-faced plate.

9. The overhead sheet-installation support tool of claim 8, in which in said flat-faced plate in its mounted position and state has a plate upper edge and forms a downwardly-extending slot extending downwardly from said plate upper edge and circumscribed by slot-edges of the handle structure, said screw having a lower shank immovably mounted within said downwardly-extending slot onto said slot-edges.

10. The overhead sheet-installation support tool of claim 9, in which said handle structure has a handle upper edge, and including a sidewardly extending flange extending sidewardly from said handle upper edge and extending along said handle upper edge edge and in a dimension extending along said handle upper edge having spaced-apart terminal end angled rearwardly relative to said handle upper edge.

11. The overhead sheet-installation support tool of claim 10, in which said sidewardly extending flange extends in a direction that is about 90 degrees relative to said one rearward-extending flattened surface.

12. The overhead sheet-installation support tool of claim 1, including an intermittently-detachable flat-faced plate mounted on said one rearwardly-extending flattened lateral surface, and said screw being immovably mounted onto said flat-faced plate.

13. The overhead sheet-installation support tool of claim 12, in which in said flat-faced plate in its mounted position and state has a plate upper edge and forms a downwardly-extending slot extending downwardly from said plate upper edge and circumscribed by slot-edges of the handle structure, said screw having a lower shank immovably mounted within said downwardly-extending slot onto said slot-edges.

14. The overhead sheet-installation support tool of claim 1, in which said handle structure has a handle upper edge, and including a sidewardly extending flange extending sidewardly from said handle upper edge and extending along said handle upper edge edge and in a dimension extending along said handle upper edge having spaced-apart terminal end angled rearwardly relative to said handle upper edge.

15. The overhead sheet-installation support tool of claim 14, in which said sidewardly extending flange extends in a direction that is about 90 degrees relative to said one rearward-extending flattened surface.

16. The overhead sheet-installation support tool of claim 11, in which said handle structure has opposite ones of said rearwardly-extending flattened lateral surface with the flattened lateral surface extending in a plane parallel with and substantially aligned with the longitudinal axis of the screw such that the handle structure provides free-space in juxtaposition thereto for moving past the flattened lateral surface an end of a rigid sheet-structure toward a forward mounting position for a rigid sheet-structure.

17. The overhead sheet-installation support tool of claim 16, in which said screw comprises hardened #2 grade steel.

18. The overhead sheet-installation support tool of claim 1, in which said screw comprises hardened #2 grade steel.

19. The overhead sheet-installation support tool of claim 1, in which said handle structure has opposite ones of said rearwardly-extending flattened lateral surface with the flattened lateral surface extending in a plane parallel with and substantially aligned with the longitudinal axis of the screw such that the handle structure provides free-space in juxtaposition thereto for moving past the flattened lateral surface an end of a rigid sheet-structure toward a forward mounting position for a rigid sheet-structure.

* * * * *